US005981451A

United States Patent [19]

Farrell et al.

[11] Patent Number: 5,981,451

[45] Date of Patent: Nov. 9, 1999

[54] NON-MOLTEN-MIX PROCESS FOR MAKING BAR COMPRISING ACYL ISETHIONATE BASED SOLIDS, SOAP AND OPTIONAL FILLER

[75] Inventors: Terence James Farrell, West New York; Georgia Shafer, Rutherford; Florencio Ratuiste, Union, all of N.J.; Michael Massaro, Congers, N.Y.; David John Lang, Ossining, N.Y.; Michael Francis Petko, Mt. Vernon, N.Y.; Gail Beth Rattinger, Teaneck, N.J.

[73] Assignee: Lever Brothers Company, New York, N.Y.

[21] Appl. No.: 09/159,054

[22] Filed: Sep. 23, 1998

[51] Int. Cl.[6] ..... C11D 11/00

[52] U.S. Cl. ..... 510/141; 510/152; 510/153; 510/155; 510/447; 510/450; 510/451; 510/474; 510/484

[58] Field of Search ..... 510/141, 152, 510/153, 155, 447, 450, 451, 474, 484

[56] References Cited

U.S. PATENT DOCUMENTS

| | | | |
|---|---|---|---|
| 4,663,070 | 5/1987 | Dobrovolny et al. | 510/152 |
| 4,832,861 | 5/1989 | Resch | 510/133 |
| 5,030,376 | 7/1991 | Lee et al. | 510/484 |
| 5,041,233 | 8/1991 | Kutny et al. | 510/152 |
| 5,284,598 | 2/1994 | Subramanyam et al. | 510/153 |
| 5,294,363 | 3/1994 | Schwartz et al. | 510/153 |
| 5,300,249 | 4/1994 | Schwartz et al. | 510/153 |
| 5,393,466 | 2/1995 | Ilardi et al. | 554/90 |
| 5,464,554 | 11/1995 | Gu et al. | 510/130 |
| 5,482,643 | 1/1996 | Chambers et al. | 510/153 |
| 5,494,612 | 2/1996 | Finucane | 510/155 |
| 5,520,840 | 5/1996 | Massaro et al. | 510/151 |
| 5,661,120 | 8/1997 | Finucane et al. | 510/153 |
| 5,770,556 | 6/1998 | Farrell et al. | 510/447 |

FOREIGN PATENT DOCUMENTS

| | | |
|---|---|---|
| 0189332 | 7/1986 | European Pat. Off. . |
| 0434460 | 6/1991 | European Pat. Off. . |
| 0459769 | 12/1991 | European Pat. Off. . |
| 94/26866 | 11/1994 | WIPO . |
| 97/43396 | 11/1997 | WIPO . |
| 98/06800 | 2/1998 | WIPO . |

*Primary Examiner*—Lorna M. Douyon
*Attorney, Agent, or Firm*—Ronald A. Koatz

[57] ABSTRACT

Novel compositions are prepared in a non-molten process. In particular, compositions comprise optional fillers with both soap and high levels of synthetic surfactants. When high levels of soap and surfactant are normally used in such process, there is a significant "grittiness" problem. Pre-processing the surfactant containing chip (e.g., "DEFI" chip) has been unexpectedly found to remedy this problem.

12 Claims, No Drawings

NON-MOLTEN-MIX PROCESS FOR MAKING BAR COMPRISING ACYL ISETHIONATE BASED SOLIDS, SOAP AND OPTIONAL FILLER

FIELD OF THE INVENTION

The present invention relates to a process for blending soap and acyl isethionate based solids (e.g., in form of noodles or flakes) in flexible amounts and ranges while maintaining good consumer properties (e.g., non-gritty bars). By "pre processing" the isethionate based solid as if to produce chips used in a final synthetic/soap based base, the isethionate solid can then be blended with soap chips in a non-molten process while significantly reducing grit normally associated with mixing isethionate based chips (e.g., "DEFI" chips) and soap chips.

BACKGROUND OF THE INVENTION

It is often desirable to combine soap together with synthetic surfactant (specifically chips comprising acyl isethionate, free fatty acid and alkali metal isethionate, typically such chips are made from the direct esterification of free fatty acids and alkali metal isethionates to form so-called "DEFI"—directly esterified fatty acid isethionate-chips). For example, adding soap to "DEFI" chips or flakes noted above reduces cost (soap being much cheaper), while adding such chips or flakes to a predominantly soap composition reduces harshness of soaps. However, mixing such "DEFI" flakes or chips with soap in a conventional process results in bars with high degree of "grittiness". Thus it has been traditionally true that combining too much soap with such chips or flakes, or adding too much chips or flakes to predominantly soap bars has resulted (when chips or flakes are co-extruded with soap chips) in bars having poor user properties. Without wishing to be bound by theory, this is believed to be caused by differences in wear rates between the chips or flakes comprising acyl isethionate and the soap chips thereby resulting in the so-called "grittiness" problem.

One method of alleviating this problem has been to use a molten process. Thus, for example, it is possible to mix much higher percentages of acyl isethionate based chips or flakes with soap chips by using a molten process in which relatively high amounts of water (i.e., 12% to 18% by wt.) are mixed with the soap and surfactant to ensure sufficient surfactant mixing after which the mixture is heated and the water removed to about 5% water (e.g., by vacuum or spray drying). The process is far more complicated, time-consuming and expensive than a non-molten process.

Unexpectedly, applicants have found that if, rather than using so-called DEFI-type chips taken directly from the esterification reaction vessel, the DEFI chip is processed further (e.g., by blending the DEFI chip with additional fatty acids, fatty acid soaps, additional surfactant such as betaine, and minors as if to form a final synthetic bar comprising soap, fatty acid and DEFI), this "pre-processed" chip can be combined with soap chips and result in significant reduction in grit of the final bars. Moreover, the preprocessed isethionate chips and soap chips can be blended in a non-molten process.

Preprocessing essentially involves blending of the "DEFI" solid (i.e., solid resulting from reaction of alkali metal isethionate and fatty acids) with fatty acid soap (e.g., blends of coconut and tallow soaps and/or alkali metal stearate), optional surfactant (e.g., betaine)and other minor components using the same process as that used to manufacture final soap (e.g., mixing component at greater than 90° C. for at least 15 minutes, cooling, for example on a chill roll and refining to form chips). This raw material so formed (without colorant, perfume) is collected in the form of noodles or chips, and then used as the Na acyl isethionate source in the current non-molten process. In this diluted and processed form, the crystallinity of the Na acyl isethionate solid is believed to be significantly reduced. This in turn is believed to greatly facilitate blending of this material into the final bar solid, which drastically reduces the occurrence of grit upon washing.

In another embodiment of the invention, grit is reduced even further by using filler in addition to preprocessed Isethionate chip flake and soap chip. Without being bound by theory, it is believed that filler acts to both aid in dispersion of the Na acyl isethionate and soap solids in the mixing process, via a grinding action, and as a diluent which makes any grit particulates less noticeable.

The art teaches manufacture of bars which are non-gritty. WO 94/26866 to Chambers, for example, teaches mixing fatty isethionate ester with soap to form bars. This is clearly, however, a process requiring isotropic solution and not a non-molten process. Further, there is nothing about pre-processing the acyl Isethionate source.

EP 434,460 to Lee et al. (Unilever) teaches soap and isethionate compositions. The soaps are made using 5 to 50% water and organic solvents and are clearly not non-molten. Also, there is again nothing about pre-processing.

U.S. Pat. No. 5,494,612 to Finucane teaches a process for producing bars comprising isethionate and soap. Although the composition may be dry-mixed (see column 7, lines 46–49), the composition must comprise less than 5% soap. If higher amounts are used in a dry-mix process, the grittiness issues resurfaces. There is also nothing about pre-processing.

Accordingly, it is an object of the invention to provide a non-molten mix process wherein a broad range of soap and acyl isethionate may be mixed without providing grittiness.

BRIEF SUMMARY OF THE INVENTION

Unexpectedly, applicants have discovered that pre-processing an Isethionate chip (e.g., blending "DEFI" chips with fatty acid, fatty acid soaps, optional surfactant and minors) prior to blending with soap chips and optional filler allows a broad flexibility range such that the soap chip and pre-processed acyl isethionate chip can be mixed in a non-molten process in broad ranges while avoiding or eliminating the grittiness problem. In a second embodiment, mixing the pre-processed chip and soap chip with filler helps eliminate grit even further.

More particularly, the present invention provides a process for making a bar comprising:

(a) 10% to 80%, preferably 20% to 80% of a chip comprising acyl isethionate (acyl isethionate comprising 25% to 75% of said chip), free fatty acid neutralized fatty acid, alkali metal isethionate and which may additionally comprise zwitterionic surfactant;

(b) 5% to 80%, preferably 10% to 60% soap (as noted, previously it would have been difficult to combine such broad levels of component (a) and soap without being concerned about grittiness); and (c) 0% to 30% by wt., preferably 5% to 20% by wt. filler (i.e., bulk, non-surfactant additive chosen to maintain good bar properties while acting as a diluent to reduce cost), wherein said process comprises:

(i) first pre-processing (a) by mixing components of (a) at a temperature greater than 90° C. for at least 15 minutes, cooling on a chill roll and refining to form chips/flakes;

(ii) adding pre-processed component (a) and components (b) and optionally (c) at ambient temperature;

(iii) mixing said components at a temperature below 60° C., preferably below 50° C., more preferably below 40° C., most preferably in the absence of heat altogether, until the components form a homogenous mass;

(iv) applying sufficient shear such that particles are finely dispersed and a flake/chip comprising (a), (b) and (c) is formed; and (v) extruding said chip to form a bar.

DETAILED DESCRIPTION OF THE INVENTION

The present invention comprises a process for making a bar which bar comprises:

(a) 20% to 80% by wt. of a chip comprising acyl isethionate, free fatty acid, neutralized fatty acid and alkali metal isethionate (may additionally comprise zwitterionic and/or alkali metal soap);

(b) 5% to 80% by wt., preferably 10% to 60%, more preferably 10% to 70% soap; and (c) 0% to 30% by wt. filler, wherein the process comprises:

(i) pre-processing (a) by mixing components of (a) at a temperature greater than 90° C. for at least 15 minutes, cooling on a chill roll and refining to form chips/flakes, (ii) adding (a), (b) and optionally (c) at ambient temperature, (iii) mixing the components at temperature below 60° C., preferably below 50° C., preferably below 40° C., most preferably without external heating at all, until the components form a homogeneous mass, (iv) applying sufficient shear until finely dispersed particles and chips are formed; and (v) extruding to form a bar.

As noted above, it is unknown to have such broad flexibility in mixing surfactants and soap, particularly levels of soap at 5%, preferably 6% and above, while forming bars with such good "grit" characteristics process. By "grit" is meant fine particulates of greater than approximately 40$\mu$ which form under washing conditions as a result of uneven surface wear and which are perceivable to the touch. While not wishing to be bound by theory, the key to the invention is believed to be that, in such a non-molten process, the alkali metal isethionate solids are pre-processed to reduce their crystallinity, making them easier to disperse throughout the bar solid.

Composition

Acyl Isethionate Based Solid

The first critical component of the compositions of the invention (component (a)) is the chip composition (a) which is to be dry-mixed with component (b). It is the uneven wear between acyl isethionate and soap which has traditionally led to the "grit" problem.

The chip composition (a) comprises acyl isethionate, free fatty acid (i.e., $C_8$ to $C_{24}$, preferably saturated fatty acid), alkali metal isethionate and neutralized fatty acid (e.g., soaps). Preferably such soaps are $C_{16}$ to $C_{18}$ fatty acid soaps such as blends of palmitic and stearic fatty acid soaps.

The chip can be combined on a Dove®-type chip used during the production of Dove®-type bars which comprises the acyl isethionate, free fatty acid and alkali metal isethionate noted above and additionally may comprise amphoteric or zwitterionic surfactant (betaines such as cocoamido propyl betaine, for example) and/or alkali metal soap (e.g., sodium stearate).

Acyl isethionates include $C_8$ to $C_{18}$ acyl isethionates. These esters are generally prepared by reaction between alkali metal isethionate with mixed aliphatic fatty acids having from 6 to 18 carbon atoms and an iodine value of less than 20. Generally at least 75% of the mixed fatty acids have 12 to 18 carbons and up to 25% have from 6 to 10 carbons. The isethionate may also be an alkoxylated isethionate as described in U.S. Pat. No. 5,393,466 to Ilardi et al. hereby incorporated by reference into the subject application The acyl isethionate generally will comprise 25 to 75% of the chip composition. Free fatty acid will generally comprise 10 to 30% preferably 15 to 25% of the chip and alkali metal isethionate will comprise generally 2 to 10%, preferably 4 to 7% of the chip.

A chip prepared from direct reaction of alkali metal isethionate and mixed fatty acids, as noted above, would traditionally be called a "DEFI" chips and when dry mixed with soap chips ("unprocessed" DEFI, less soap) these are traditionally the reactions which form gritty bars. However, according to the subject invention, when such DEFI chips are further processed (e.g., with alkali metal soap and optional surfactant) to form "processed" DEFI chips more akin to a traditional "Dove"-type chip before combining with soap.

As noted, in a traditional Dove® chip, the chip (i.e., chip to be pre-processed before combining with soap and optional filler) may further comprise amphoteric or zwitterionic surfactant and or alkali metal soap.

Amphoteric detergents which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. They will usually comply with an overall structural formula:

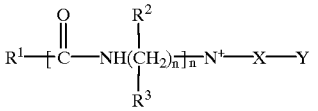

where $R^1$ is alkyl or alkenyl of 7 to 18 carbon atoms;

$R^2$ and $R^3$ are each independently alkyl, hydroxyalkyl or carboxyalkyl of 1 to 3 carbon atoms;

m is 2 to 4;

n is 0 to 1;

X is alkylene of 1 to 3 carbon atoms optionally substituted with hydroxyl, and

Y is $—CO_2—$ or $—SO_3—$

Suitable amphoteric detergents within the above general formula include simple betaines of formula:

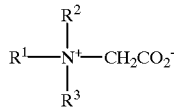

and amido betaines of formula:

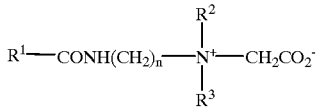

where n is 2 or 3.

In both formulae $R^1$, $R^2$ and $R^3$ are as defined previously. $R^1$ may in particular be a mixture of $C_{12}$ and $C_{14}$ alkyl groups derived from coconut so that at least half, preferably at least three quarters of the groups $R^1$ have 10 to 14 carbon atoms. $R^2$ and $R^3$ are preferably methyl.

A further possibility is that the amphoteric detergent is a sulphobetaine of formula:

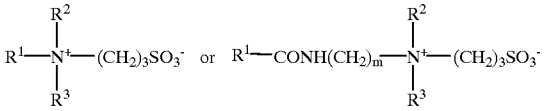

where m is 2 or 3, or variants of these in which $—(CH_2)_3SO_3—$ is replaced by

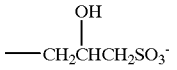

In these formulae $R^1$, $R^2$ and $R^3$ are as discussed previously.

If present, amphoteric or zwitterionic may comprise 1% to 6%, preferably 2% to 4% of the chip.

Finally, alkali metal soap comprises 5% to 20%, preferably 7% to 15% of the chip.

Other components which may be found in the chip include, for example water. Water is preferably present in an amount of about 2 to 10%, preferably 3 to 8%, generally about 5% of the chip.

Soap

A second required component of the invention is "soap". As noted, in a dry mix process, it has historically been difficult to mix large amounts of soap (e.g., above 5%) with surfactant (e.g., isethionate) or conversely to mix surfactant in a predominantly soap bar without having "gritty" bars. "Grit" represents fine particulates (generally greater than about 40 microns) which form during wash or as a result of uneven wear rates and which are perceivable to the touch. As noted, isethionate has previously been used as part of un-processed "DEFI" type chip and not the processed DEFI of the invention.

The term "soap" is used herein in its popular sense, i.e., the alkali metal or alkanol ammonium salts of aliphatic alkane- or alkene monocarboxylic acids. Sodium, potassium, mono-, di- and tri-ethanol ammonium cations, or combinations thereof, are suitable for purposes of this invention. In general, sodium soaps are used in the compositions of this invention, but from about 1 % to about 25% of the soap may be potassium soaps. The soaps useful herein are the well known alkali metal salts of natural of synthetic aliphatic (alkanoic or alkenoic) acids having about 12 to 22 carbon atoms, preferably about 12 to about 18 carbon atoms. They may be described as alkali metal carboxylates of acrylic hydrocarbons having about 12 to about 22 carbon atoms.

Soaps having the fatty acid distribution of coconut oil may provide the lower end of the broad molecular weight range. Those soaps having the fatty acid distribution of peanut or rapeseed oil, or their hydrogenated derivatives, may provide the upper end of the broad molecular weight range.

It is preferred to use soaps having the fatty acid distribution of coconut oil or tallow, or mixtures thereof, since these are among the more readily available fats. The proportion of fatty acids having at least 12 carbon atoms in coconut oil soap is about 85%. This proportion will be greater when mixtures of coconut oil and fats such as tallow, palm oil, or non-tropical nut oils or fats are used, wherein the principle chain lengths are $C_{16}$ and higher. Preferred soap for use in the compositions of this invention has at least about 85% fatty acids having about 12 to 18 carbon atoms.

Coconut oil employed for the soap may be substituted in whole or in part by other "high-alluric" oils, that is, oils or fats wherein at least 50% of the total fatty acids are composed of lauric or myristic acids and mixtures thereof. These oils are generally exemplified by the tropical nut oils of the coconut oil class. For instance, they include: palm kernel oil, babassu oil, ouricuri oil, tucum oil, cohune nut oil, murumuru oil, jaboty kernel oil, khakan kernel oil, dika nut oil, and ucuhuba butter.

A preferred soap is a mixture of about 15% to about 20% coconut oil and about 80% to about 85% tallow. These mixtures contain about 95% fatty acids having about 12 to about 18 carbon atoms. The soap may be prepared from coconut oil, in which case the fatty acid content is about 85% of $C_{12}$–$C_{18}$ chain length.

The soaps may contain unsaturation in accordance with commercially acceptable standards. Excessive unsaturation is normally avoided.

Soaps may be made by the classic kettle boiling process or modern continuous soap manufacturing processes wherein natural fats and oils such as tallow or coconut oil or their equivalents are saponified with an alkali metal hydroxide using procedures well known to those skilled in the art. Alternatively, the soaps may be made by neutralizing fatty acids, such as lauric ($C_{12}$), myristic ($C_{14}$), palmitic ($C_{16}$), or stearic ($C_{18}$) acids with an alkali metal hydroxide or carbonate.

In one embodiment of the invention, the bar will be greater than 50% synthetic surfactant, as a percentage of surfactant system, but, in accordance with principles of the invention, 5, 10, 20 or 40% of system may be soap without having the "grittiness" problem normally associated with mixing such large amounts of soap in presence of synthetic. The bar surfactant system may comprise greater than 40% soap, but, again in accordance with principles of the invention, i.e., 20 or 40% synthetic surfactant may be added while avoiding "grittiness" problem associated with dry mixing such large amount of synthetic in presence of soap.

In a different embodiment of the invention, a third optional component which may be used are filler ingredients. These help reduce grit even further.

The filler can be a non-oil based solid at processing temperature such as, for example, starch and including water soluble (i.e., having solubility of at least 10% in water)

starches such as maltodextrin, or a mineral-type filler such as talc or alkali metal carbonates.

In addition to the components noted above, the base bar composition may contain 5–10% by wt. water, and structuring aid or secondary filler (e.g., wax such as polyethylene wax or paraffin wax or fatty alcohol, preferably $C_{14}$–$C_{18}$ alcohols). The aid can be 0 to 15%, preferably 2% to 10% fatty acid, i.e., $C_8$to $C_{24}$ fatty acid (in addition to that defined fatty acid in (a)). Generally, this is a straight chain, saturated fatty acid although this is not necessarily the case. It may also be a preferably straight chain, saturated $C_8$ to $C_{24}$ alcohol or ether derivative thereof.

The structuring aid may also be polyalkylene glycol with molecular weight between 2,000 and 20,000, preferably 3000 and 10,000. Such PEGs are commercially available, such as those marketed under tradename PEG 8000® or PEG 4000® from Union Carbide.

Structuring aids can also be selected from water soluble polymers, optionally chemically modified with hydrophobic moiety or moieties, for example, EO-PO block copolymer, hydrophobically modified PEGs such as POE(200-glycerylstearate, glucam DOE 120 (PEG Methyl Glucose Dioleate), and Hodg CSA-102 (PEG-150 stearate), and Rewoderm® (PEG modified glyceryl cocoate, palmate or tallowate) from Rewo Chemicals.

Other structuring aids which may be used include Amerchol Polymer HM 1500 (Nonoxynyl Hydroethyl Cellulose).

Processing

According to the subject of the invention, components (i.e., pre-processed (a) component (b) and optional (c)) are blended in a mixer (speed of blending varying with type and strength of mixer) until homogeneous at temperature below 60° C., preferably below 50° C., more preferably below 40° C., and preferably in absence of heat-source altogether.

The blend is then milled 1 to 4 times (e.g., through a three roll mill) and cut (e.g., into ribbons). The cut ribbons may be passed through the mill an additional one or two times or more as required. The ribbons are further processed through an extruder and then extruded cut and stamped.

The following examples are intended to further illustrate the invention and are not intended to limit the invention in any way.

Unless stated otherwise, all percentages are intended to be percentages by weight.

EXAMPLES

Example 1

Process for Making Mild Bar with Na Acyl Isethionate (Pre-processed), Soap and Optional Filler The following table illustrates the innovation which is the basis for this application. That is, if Na acyl Isethionate is used in its "un-processed form (i.e., DEFI", bars are unacceptably gritty. On the other hand, pre-processing the DEFI (to form a Dove-type chip) results in virtually grit free bars. The grit score is the average assessment of 5 panelists. The panelists were given bars and asked to wash as they normally would (water temperature at approximately ambient) and to grade according to given scale. The scale is 0: none, 1: smooth, 2: slight, 3: moderate, 4: extreme.

| Example | Formulation | Grit Score: x = DEFI (Un-processed) (Comparatives) | Grit Score: x = Processed DEFI |
|---|---|---|---|
| 1 | 75% x/10% soap/10% talc | 2 | 0 |
| 2 | 45% x/45% soap/10% talc | 4 | 0 |
| 3 | 10% x/80% soap/10% talc | 4 | 0 |
| 4 | 50% x/50% soap/0% talc | 4 | 1 |
| | Average grit score | 3.7 | 0.25 |

Any bar with an average grit score of 2 or greater is judged to be unacceptable.

It should be noted that DEFI (unprocessed) is defined as a Na acyl isethionate concentrate in solid form. Its approximate composition is as follows:

| | |
|---|---|
| Na acyl Isethionate | 71% |
| Palmitic-stearic acid | 16% |
| Na isethionate | 7% |
| Coconut fatty acid | 4% |
| Water | 2% |

It is referred to as unprocessed DEFI, as this is the raw material obtained directly from the esterification reaction vessel in the plant.

With "processed" DEFI, the DEFI raw material has been heated and mixed with other components (as below), cooled and refined. Its approximate composition is as follows:

| | |
|---|---|
| DEFI | 60–80% |
| Free fatty acid | 5–10% |
| Soap* | 5–10% |
| Betaine | 1–5% |
| Na stearate | 1–5% |
| Water | 2–8% |
| Minors | 1–5% |

*mixture of tallow and coconut soaps

According to the invention, when processed "DEFI" is combined with soap and optional filler (formulae 1–4, far right column), the grit is significantly lower then if DEFI is not processed (formulae 1–4, middle column).

We claim:

1. A process for making a bar composition comprising:

(a) about 10% to about 80% by weight of a chip or flake comprising acyl isethionate, free fatty acid, alkali metal isethionate and salts of fatty acid;

(b) 5% to 80% by wt. soap; and (c) 0% to 30% by wt. filler;

wherein said process comprises:

(i) first pre-processing (a) by mixing components of (a) at a temperature greater than 90° C. for at least 15 minutes, cooling on chill roll and refining to form chips or noodles;

(ii) mixing components (a), (b), (c) at a temperature below about 60° C., until the components form a homogenous mass;

(iii) applying sufficient shear such that particles are finely dispersed and flake/chip is formed; and (iv) extruding chip formed in (iii) to form a bar.

2. A process according to claim 1, wherein (a) additionally comprises zwitterionic surfactant.

3. A process according to claim 1, comprising 10% to 60% by wt. soap.

4. A process according to claim 1, comprising 10% to 70% by wt. soap.

5. A process according to claim 1, comprising 5% to 20% by wt. filler.

6. A process according to claim 5, wherein filler is a non-oil based solid at room temperature.

7. A process according to claim 6, wherein filler is a water-soluble starch.

8. A process according to claim 7, wherein water-soluble starch is maltodextrin.

9. A process according to claim 5, wherein filler is a mineral filler.

10. A process according to claim 9, wherein filler is talc or an alkali metal carbonate.

11. A process according to claim 1, wherein in step (ii), components are mixed at temperatures below 40° C.

12. A process according to claim 6, wherein in step (ii), components are mixed in absence of heat.

* * * * *